United States Patent [19]

May

[11] 3,960,270

[45] June 1, 1976

[54] CIGARETTE CASE

[76] Inventor: Bob May, 414 Clinton Place, River Forest, Ill. 60305

[22] Filed: Apr. 23, 1975

[21] Appl. No.: 570,787

[52] U.S. Cl. ..... 206/256; 206/539; 217/62; 220/22; 220/346

[51] Int. Cl.[2] ..... B65D 1/24; B65D 43/12; B65D 85/10

[58] Field of Search ..... 206/256, 267, 242, 539, 206/203; 217/62, 18; 220/21, 22, 23, 245, 246; 229/15

[56] References Cited

UNITED STATES PATENTS

| | | | |
|---|---|---|---|
| 2,531,737 | 11/1950 | Lyon, Jr. | 217/62 |
| 3,033,355 | 5/1962 | Van Sickle | 206/539 |
| 3,207,566 | 9/1965 | Grieco et al. | 220/22 |
| 3,817,372 | 6/1974 | Smith | 206/539 |

*Primary Examiner*—William T. Dixson, Jr.
*Attorney, Agent, or Firm*—Paul H. Gallagher

[57] ABSTRACT

A cigarette case having a closure member movable to selective positions for exposing or releasing a single or individual cigarette. The closure member and body of the case have detents indicating the position of the closure member to expose the desired cigarette, or be at a desired position, for exposing or releasing the next cigarette. The case includes means forming cells for the individual cigarettes.

4 Claims, 6 Drawing Figures

Fig. 1.
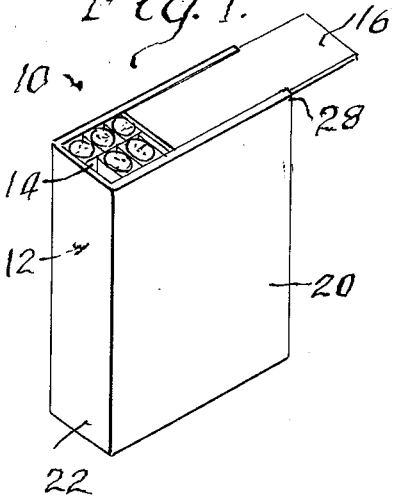
Fig. 2.
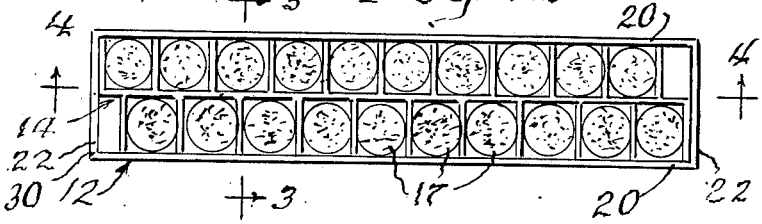
Fig. 4.
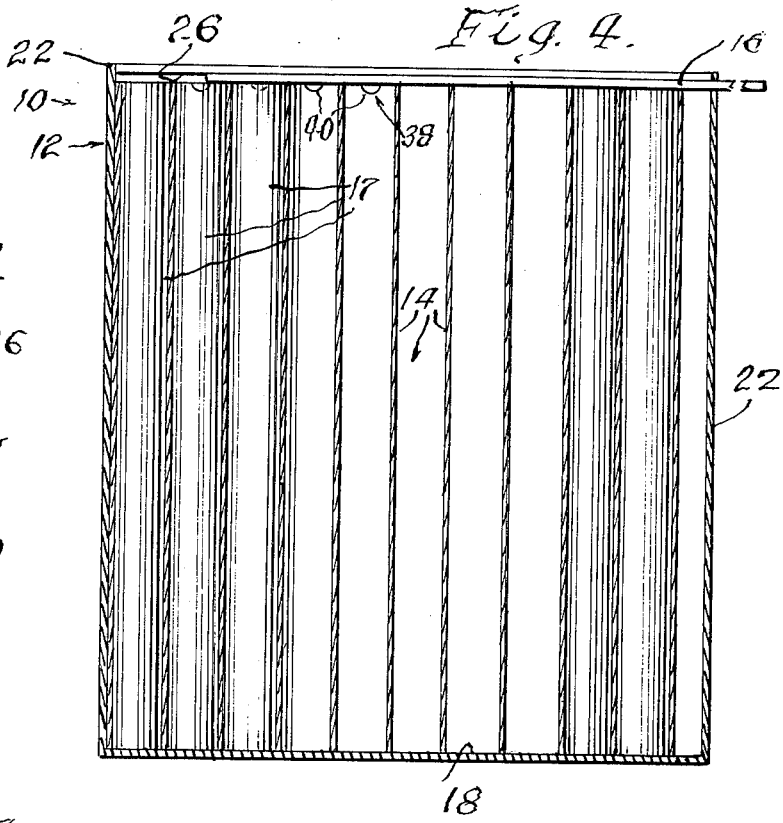
Fig. 3.
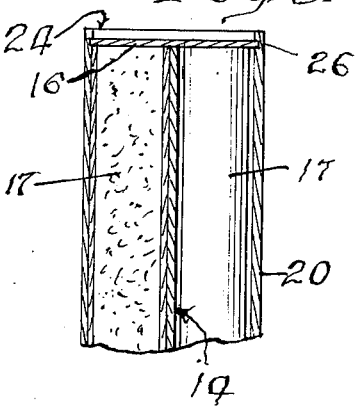
Fig. 6.
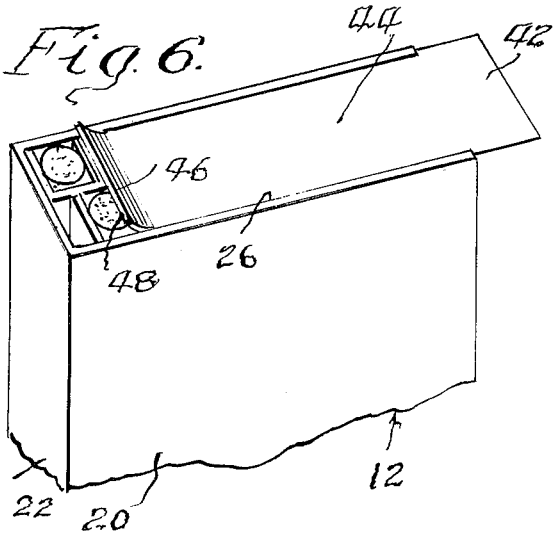
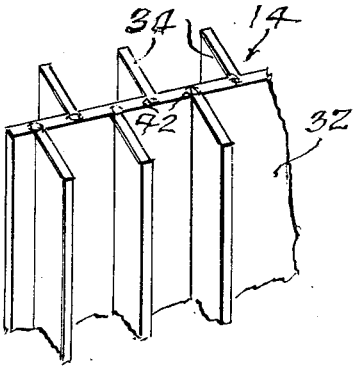
Fig. 5.

CIGARETTE CASE

OBJECTS OF THE INVENTION

A broad object of the invention is to provide a cigarette case which is actuatable for exposing or releasing a single cigarette upon desired manipulation thereof.

Another broad object is to provide a cigarette case of novel construction that facilitates placing the cigarettes into it, and such a simple construction that also facilitates closing of the case for retaining the cigarettes therein.

Still another object is to provide a cigarette case of the foregoing general nature which includes a case body and a closure member, and having a novel arrangement of detent means between the body and the closure member to assist the user to properly position the closure member for exposing each individual cigarette and releasing it.

An additional object is to provide a cigarette case of the foregoing general nature which is of extremely simple construction, having a case body, and an insert positioned in the case body forming cells for receiving the individual cigarettes with the additional feature referred to above that the closure member is actuatable to desired positions relative to the insert member for exposing each cell, and the cigarette in that cell individually so as to release and remove a single cigarette as desired without accidental removal of other cigarettes.

An additional object is to provide, in a modified form of the device, a cigarette case having a novel closure member which, after insertion of the cigarettes into the case, engages the ends of the cigarettes so as to move them in the final packed position by the actuation of the closure member itself.

DESCRIPTION OF A PREFERRED EMBODIMENT

In the drawings:

FIG. 1 is a perspective and semi-diagrammatic view of a cigarette case made according to the present invention;

FIG. 2 is a large scale top view of the case of FIG. 1;

FIG. 3 is a transverse vertical sectional view taken at line 3-3 of FIG. 2;

FIG. 4 is a longitudinal vertical sectional view taken at line 4-4 of FIG. 2;

FIG. 5 is a fragmentary perspective view of the insert included in the case body, and FIG. 6 is a perspective semi-diagrammatic view of a modified form of a cigarette case.

Referring in detail to the drawings, FIG. 1 shows the cigarette case as a whole at 10 which includes a case body 12, an insert or filler 14 and a closure member 16 all of which are described in detail hereinbelow.

The case body 12 may be of any suitable material such, for example, as metal or plastic and is generally rectangular and preferable of a size to hold 20 cigarettes, the number customarily provided in a package sold on the market, the cigarettes being identified 17. The case body itself is a generally rectangularly or cubically shaped item, having a bottom element 18, sidewalls 20, end walls 22 and an open top 24, and defining an interior space. The sidewalls 20 at the open top of the case body are provided with grooves 26, these grooves providing a slide or guide way for the closure member 16. The closure member is inserted into position from a first end 28 of the case body and at the other and opposite end is an element 30 (FIG. 4) of the end wall 22 forming a stop preventing the closure member from being pushed out that end.

Reference is next made to FIG. 5 which is a fragmentary perspective view of the insert 14 fitted in the case body. This insert includes a central longitudinal element or wall 32 and side vanes or walls 34 extending laterally therefrom. This insert may be of any suitable material such as metal or plastic, etc., and the longitudinal element 32 provides the backbone of the insert and the side vanes 34 together the longitudinal element provides cells 36. The insert is put in the case body and when so placed the cells 36 together with the side walls of the case body confine the cigarettes as when they are placed in the case body as referred to again hereinbelow. This insert as so put in the case body is positioned as appears in FIG. 2. It is to be noted that the vanes 34 on opposite sides of the longitudinal wall are offset relative to the two sides, and the cells formed are thus staggered longitudinally along the case.

In utilizing the cigarette case, the closure member 16 is withdrawn and the cigarettes are placed individually in the cells 36. Then the closure member 16 is put in closing position, namely through the open end 28 of the open top of the case and pushed to the opposite end. The closure member of course is in the grooves 26 and held thereby against removal outwardly or upwardly longitudinally of the case body, and the closure is normally prevented by friction from being accidentally moved out of the open end. As mentioned above the wall element or stop element 30 holds the closure member from passing through the opposite end.

In a preferred embodument of the device, the closure member 16 as indicated above moves into position as confined by the grooves 26 but it is pointed out that the space between the closure element and the bottom element 18 is the same as the length of the cigarettes so that the closure member does not compact the cigarettes in length and so that when the closure member is withdrawn there remains the same space equivalent to the length of the cigarettes as shown particularly in FIG. 4. In other words the closure member slides along the plane of the top ends of the cigarettes, and when the closure member covers a cigarette, it confines it against accidentally falling out, but when the one before it is released, as indicated in FIG. 4, it can be easily removed, and there is no deleterious effect as by confinement lengthwise of the cigarette.

The cells 36 as between the two sides of the longitudinal member 32 are staggered longitudinally of the insert so as to facilitate exposure of a single cigarette at a time. To this end the closure member 16 may be withdrawn only a half-cell increment at a time, to expose a single cigarette from the one or the other side and not expose more than one. For assisting this operation it is preferred that detent means 38 be provided which includes a projection 40 on the closure member 16 and a series of recesses 42 on the longitudinal element 32 of the insert. The user will get the "feel" of the projection snapping into the recesses, but this is very shallow and does not materially affect the ease of movement of the closure member. There may be a single projection 40 on the closure member but a series of recesses 42 in the insert. The recesses are spaced apart a space equivalent to one-half cell, that is, as the projection falls into a recess at successive positions a single cigarette is exposed on the one or the other side of the insert. This detent means is not necessary and the user may desire to simply use judgment by observation in sliding the closure member 16 outwardly. After a cigarette is removed it is usually convenient to slide the closure member to closed position to maintain all of the elements of the case within the minimum dimensions.

It will be understood that it is not essential that the insert 14 be incorporated, and it is possible within the overall utilization of the case to provide only the case body and closure member, without the insert and place the cigarettes in position in "packed" form, preferably staggered so that each cigarette on one side is in the recess between two cigarettes on the side. In the use of the cigarette case in this fashion the user may merely move the closure member in opening direction a distance equivalent to one half of a cigarette and this may be done by observation, or judgment, or according to past experience.

FIG. 6 shows a modified form of a cigarette case. The case body 12 may be similar to that described above, in which the side walls 20 have the grooves 26. The present form includes a closure member 42 which may be generally similar to the closure member 16 but it is different in detail construction. The closure member 42 includes a main body portion 44 of a width to ride under the grooves 26, but at its leading or "forward" end it has a portion 46 of reduced width so as fit between the edges of the side walls 20 and at its extreme leading end is an upturned curved element 48 which provides camming action on the cigarettes. For example the height dimension of the case body may be slightly less than the length of the cigarettes and the cigarettes can be placed in position and then the closure member 42 slid into closed position, and as it is so moved the camming element 48 will engage the cigarettes and produce a very slight compacting action so that the cigarettes when the closure member is closed are in fully confined position, that is, not permitted to jostle or rattle vertically. The form of FIG. 6 may or may not include the insert of FIG. 5 according to desires.

I claim:

1. A cigarette case including a case body defining an interior space and having an open upper end for receiving cigarettes of predetermined length therethrough into the case body and withdrawing out of it, the case body having a length equivalent to the length of the cigarettes, a width less than the length, and a thickness substantially equivalent to the thickness of two cigarettes fitted side-by-side, an insert in the case body and including a central wall dimensioned substantially equivalent to the length and width of the case body, and side vanes extending laterally from each of opposite sides of the central wall, the side vanes being spaced apart in the direction of the width of the central wall and extending longitudinally in the direction of the length thereof, and terminating at the open upper end of the case body, the side vanes and central wall defining cells between adjacent side vanes, and the cells thereby terminating at the open upper end of the case body, and a closure member mounted in the case body in position closing the open upper end thereof and slidable therein in the direction of the width of the case body for sequentially exposing cigarettes which are in the cells to the open upper end, the closure member being so positioned in the case body and the case being otherwise so dimensioned and proportioned that the closure member when in closing position is effective for confining cigarettes in the case against movement lengthwise but without compacting them.

2. A cigarette case according to claim 1 wherein the insert is separate and removable from the case body, and the cells are open in direction facing laterally outwardly from the central wall, and their open sides are closed by the respective wall elements of the case body.

3. A cigarette case according to claim 1 wherein the cells on opposite sides of the central wall are relatively staggered in direction of the width of the latter.

4. A cigarette case according to claim 3 wherein the closure member and insert have cooperating detent elements releasably interengaging at positions spaced along the width of the central wall so as to correspondingly locate the closure member at successive positions along the direction of the width of the central wall spaced apart a distance equivalent one-half the width of a cell, whereby to expose only one, but a full one, cell at each position, at respectively opposite sides of the central wall.

* * * * *